US008550395B2

(12) United States Patent
Nash et al.

(10) Patent No.: US 8,550,395 B2
(45) Date of Patent: Oct. 8, 2013

(54) APPARATUS AND METHOD FOR DISPENSING TAPE

(75) Inventors: Jorge A. Nash, Vancouver, WA (US); Yang Tri Lai, Tigard, OR (US)

(73) Assignee: Adalis Corporation, Vancouver, WA (US)

( * ) Notice: Subject to any disclaimer, the term of this patent is extended or adjusted under 35 U.S.C. 154(b) by 979 days.

(21) Appl. No.: 12/621,853

(22) Filed: Nov. 19, 2009

(65) Prior Publication Data

US 2010/0123037 A1 May 20, 2010

Related U.S. Application Data

(60) Provisional application No. 61/199,782, filed on Nov. 19, 2008.

(51) Int. Cl.
*B65H 19/18* (2006.01)

(52) U.S. Cl.
USPC ..... 242/555.4; 242/556

(58) Field of Classification Search
USPC ..... 242/551, 553, 555, 555.3, 555.4, 556; 24/31 L, 38, 31 F, 182, 196, 701, 593.1, 24/580.11, 464, 298, 302, 265 EC
See application file for complete search history.

(56) References Cited

U.S. PATENT DOCUMENTS

| | | | | |
|---|---|---|---|---|
| 1,464,463 | A * | 8/1923 | Wood | 242/555.4 |
| 4,917,327 | A | 4/1990 | Ausbury, Jr. et al. | |
| 6,325,324 | B1 | 12/2001 | Getz et al. | |
| 6,345,660 | B2 * | 2/2002 | Tharpe et al. | 242/555.4 |
| 7,007,883 | B2 | 3/2006 | Fairchild | |
| 7,121,497 | B2 | 10/2006 | Robitaille et al. | |
| 7,461,808 | B2 * | 12/2008 | Bradshaw et al. | 242/555.4 |
| 7,934,675 | B2 * | 5/2011 | Mailyan et al. | 242/555.4 |
| 8,070,087 | B2 * | 12/2011 | Maness et al. | 242/555.4 |
| 2005/0242225 | A1 | 11/2005 | Robitaille et al. | |
| 2007/0018030 | A1 | 1/2007 | Bradshaw et al. | |
| 2009/0068398 | A1 * | 3/2009 | Mailyan et al. | 428/120 |

FOREIGN PATENT DOCUMENTS

| | | |
|---|---|---|
| CA | 2447498 | 11/2003 |

OTHER PUBLICATIONS

Adalis™ Installation, Operations & Parts Manual for Adalis™ RPT System published 2002.

* cited by examiner

*Primary Examiner* — William A Rivera
(74) *Attorney, Agent, or Firm* — Kristen Stone

(57) ABSTRACT

A dispensing apparatus includes a first running spool of elongated material and second and third stand-by spools of elongated material. The first spool has a trailing end portion and a first obstacle element secured to its trailing end portion. The second spool has a leading end portion and a first catching mechanism secured to the leading end portion, as well as a trailing end portion with a second obstacle element secured to its trailing end portion. The third spool has a leading end portion and a second catching mechanism secured to its leading end portion. A support member is configured to at least partially support the leading end portions of both the second and third spools.

17 Claims, 10 Drawing Sheets

APPARATUS AND METHOD FOR DISPENSING TAPE

CROSS REFERENCE TO RELATED APPLICATION

This application claims the benefit of U.S. Provisional Application No. 61/199,782, filed on Nov. 19, 2008. The entire disclosure of U.S. Provisional Application No. 61/199,782 is considered to be part of the disclosure of the following application and is hereby incorporated by reference.

FIELD

The present invention relates to embodiments of an apparatus and method for dispensing elongated material, such as tape, from a roll of the material and a method for automatically splicing the tail portion of one material, such as tape, to the leading portion of another from a set of cascaded staged rolls of material.

BACKGROUND

Modern consumer and industrial packaging often includes reinforcing tapes or tear tapes as part of their construction. Various tape dispensers have been devised to dispense such tapes into corrugator and packaging equipment. Over the years, various methods have been introduced to increase the efficiency and speed of these tape dispensing systems.

For example, one way to increase efficiency is to increase the size of the tape rolls being used. By using "oversized" or large rolls of material the amount of tape that can be dispensed before needing to stage additional rolls can be increased. However, these oversized rolls of material typically weigh more than 40 pounds, which exceeds the weight that many companies allow workers to safely handle or lift and may exceed the weight restrictions regulated by the government. In such cases, the material would be required to be handled by a mechanical lifting apparatus when movement or staging is required. For example, Marotech, a Canadian company, has a two-tape system called MaroCrate™. The system provides rolls of material that weigh approximately 100 pounds each. This system is described in more detail in Canadian Patent 2,447,498 and U.S. Pat. No. 7,121,497.

In addition, because of the increased inertia, larger rolls are harder to accelerate and stop. Moreover, these larger rolls experience excessive tension during acceleration and tape overrun during braking. During splicing with the current MaroCrate™ technology, operators must slow the corrugator to approximately 600 feet per minute to prevent splice failures and even at that speed, roll-to-roll splice failures can occur.

Another limitation to using relatively large rolls of material is that if a quality defect is found on one of these large material rolls, the scrap or waste factor potential increases dramatically.

Other systems include one or more staged rolls to increase efficiency and reduce down-time of the machine. For example, U.S. Pat. No. 4,917,327 ("the '327 patent") to Asbury et al., the entire disclosure of which is incorporated herein by reference, discloses a system for automatically splicing together the trailing end portion of a spool, or roll, of tape to the leading end portion of a new spool of tape without interrupting the dispensing process. To prevent the tape from breaking under the strain caused by the inertia of the new spool of tape (which is initially at rest), the tape path is provided with a tension-control mechanism. In response to an increase in tension in the tape, the tension-control mechanism moves to shorten the length of the tape path, thereby relieving the increased tension in the tape. As the new spool comes up to speed, the tension-control mechanism, under the influence of a biasing mechanism, returns to its initial position to increase the path of the tape length.

Another known method of splicing the trailing end of one roll of material to the leading end of another roll of material is the multiple roll splice system known as the Adalis RPT® System, which is manufactured and sold by Adalis Corporation. The RPT® System dispensing apparatus is relatively long in length because of the required horizontal staggering of various rolls, which can be a significant disadvantage since corrugators typically have limited space available to place the tape dispensers when running.

The Adalis RPT® System approach also does not have a means to prevent the active roll of material from inadvertently and prematurely pulling a staged roll of material into motion before the active roll is depleted of tape, which can occur if an imperfection on the running tape, such as a glob of glue, catches the splicing device on the staged roll.

SUMMARY

The present invention is directed to various embodiments of an apparatus and method for dispensing elongated material, such as tape, from a spool of such material and for auto-splicing the tail portion of one tape to the leading portion of another on cascaded staged rolls.

In one embodiment, an apparatus for dispensing elongated material from a roll of material is disclosed. The apparatus comprises a first running spool of elongated material, and at least second and third spools of elongated material. The first running spool of elongated material has a trailing end portion and a first obstacle element secured to its trailing end portion. The second spool of elongated material has a leading end portion and a first catching mechanism secured to the leading end portion. The second spool also has a trailing end portion with a second obstacle element secured to its trailing end portion. The third spool of elongated material has a leading end portion and a second catching mechanism secured to its leading end portion. A support member is configured to at least partially support and separate the leading end portions of both the second and third spools and prevent them from contacting and adhering to each other and the running spool of material. The first obstacle element is sized to engage the first catching mechanism when the first obstacle element and the first catching mechanism are brought into contact with each other, and the second obstacle element is sized to engage the second catching mechanism when the second obstacle element and the second catching mechanism are brought into contact with each other.

In one specific implementation, the apparatus further comprises a fourth spool of elongated material having a leading end portion and a third catching mechanism secured to its leading end portion. The third spool further comprises a trailing end portion with a third obstacle element secured to its trailing end portion, and the third obstacle element is sized to engage the third catching mechanism when the third obstacle element and the third catching mechanism are brought into contact with each other. The support member is configured to at least partially support the leading end portion of the fourth spool and prevent it from contacting and adhering to the leading end portion of the third spool. In another specific implementation, the support member is movable from a first position to a second position. In another specific implementation, the support member is movable from the first position to the second position by rotating the support member about a pivot member.

In another implementation, the support member further comprises at least one holding member configured to releasably hold at least one of the first catching mechanism and the second catching mechanism until the catching mechanism engages an obstacle from a preceding roll of material. In another implementation, the support member is positioned within an outer envelope, the outer envelope comprising a perimeter defined by the outer edges of the first, second, and third spools of elongate materials.

In another embodiment, an apparatus for dispensing elongated material from a roll of material is provided. The apparatus comprises a first running spool of elongated material having a trailing end portion and a first obstacle element secured to its trailing end portion; and a second spool of elongated material having a leading end portion and a first catching mechanism secured to the leading end portion. The second spool also has a trailing end portion with a second obstacle element secured to its trailing end portion. The apparatus also includes a support member configured to at least partially support the leading end portions of both the second and third spools. The support member further comprises a holding member configured to releasably hold the first catching mechanism. The first obstacle element is sized to engage the first catching mechanism when the first obstacle element and the first catching mechanism are brought into contact with each other when the first spool becomes depleted. When the obstacle engages the catching mechanism, the holding member releases the catching mechanism and allows the apparatus to dispense material from the second roll.

In specific implementations, the holding member is configured to apply a holding force to the first catching mechanism. The holding force is overcome when the first obstacle element engages the first catching mechanism. In another specific implementation, the holding member is a spring clip.

In another embodiment, an apparatus for dispensing elongated material from a roll of material is provided. The apparatus comprises a first running spool of elongated material disposed on a first spindle. The first spool has a trailing end portion and a first obstacle element secured to its trailing end portion. The apparatus also comprises a second spool of elongated material disposed on a second spindle. The second spool has a leading end portion and a first catching mechanism secured to the leading end portion. The second spool also has a trailing end portion with a second obstacle element secured to its trailing end portion. The apparatus also comprises a resisting member moveable between a first configuration and a second configuration. In the first configuration the resisting member applies a force to the second spindle to resist the rotation of the second spool of material, and in the second configuration the resisting member does not apply a force to the second spindle or applies a force that is smaller than the force applied in the first configuration. The first obstacle element is sized to engage the first catching mechanism when the first obstacle element and the first catching mechanism are brought into contact with each other to splice the material from the first roll to the material from the second roll. The pulling force of the splice is sufficient to overcome the resistance of the resisting member and allow the apparatus to dispense material from the second spool. In specific implementations, the resisting member comprises a bumper that engages with the second spindle. In other specific implementations, the resisting member is pivotable between the first configuration and the second configuration.

In another embodiment, a method of splicing elongate material in a dispenser is provided. The method comprises providing a first spool of elongate material in a first position on a dispenser, the first spool having a trailing end portion and a first obstacle element secured to its trailing end portion. The method further comprises dispensing material from the first spool and providing a second spool of elongate material in a second position, the second spool having a leading end portion and a first catching mechanism secured to the leading end portion, the second spool also having a trailing end portion with a second obstacle element secured to its trailing end portion. The method further comprises providing a third spool of elongated material having a leading end portion and a second catching mechanism secured to its leading end portion. The method further comprises placing the first catching mechanism of the second spool around material being dispensed from the first spool, and placing the second catching mechanism of the third spool around the leading end portion of the second spool. The method further comprises positioning the first and second catching mechanisms in a splicing area, the splicing area being defined by an outer envelope, the outer envelope comprising a perimeter defined by the outer edges of the first, second, and third spools of elongate materials.

In one specific implementation, the act of positioning the first and second catching mechanisms in the splicing area includes supporting the leading end portions of the second and third spools on a support member in the splicing area. In other specific implementations, the act of positioning the first and second catching mechanisms in the splicing area further comprises temporarily attaching the first and second catching mechanisms to one or more holding members on the support member.

The foregoing and other features and advantages of the invention will become more apparent from the following detailed description, which proceeds with reference to the accompanying figures.

DETAILED DESCRIPTION

Figure 1:
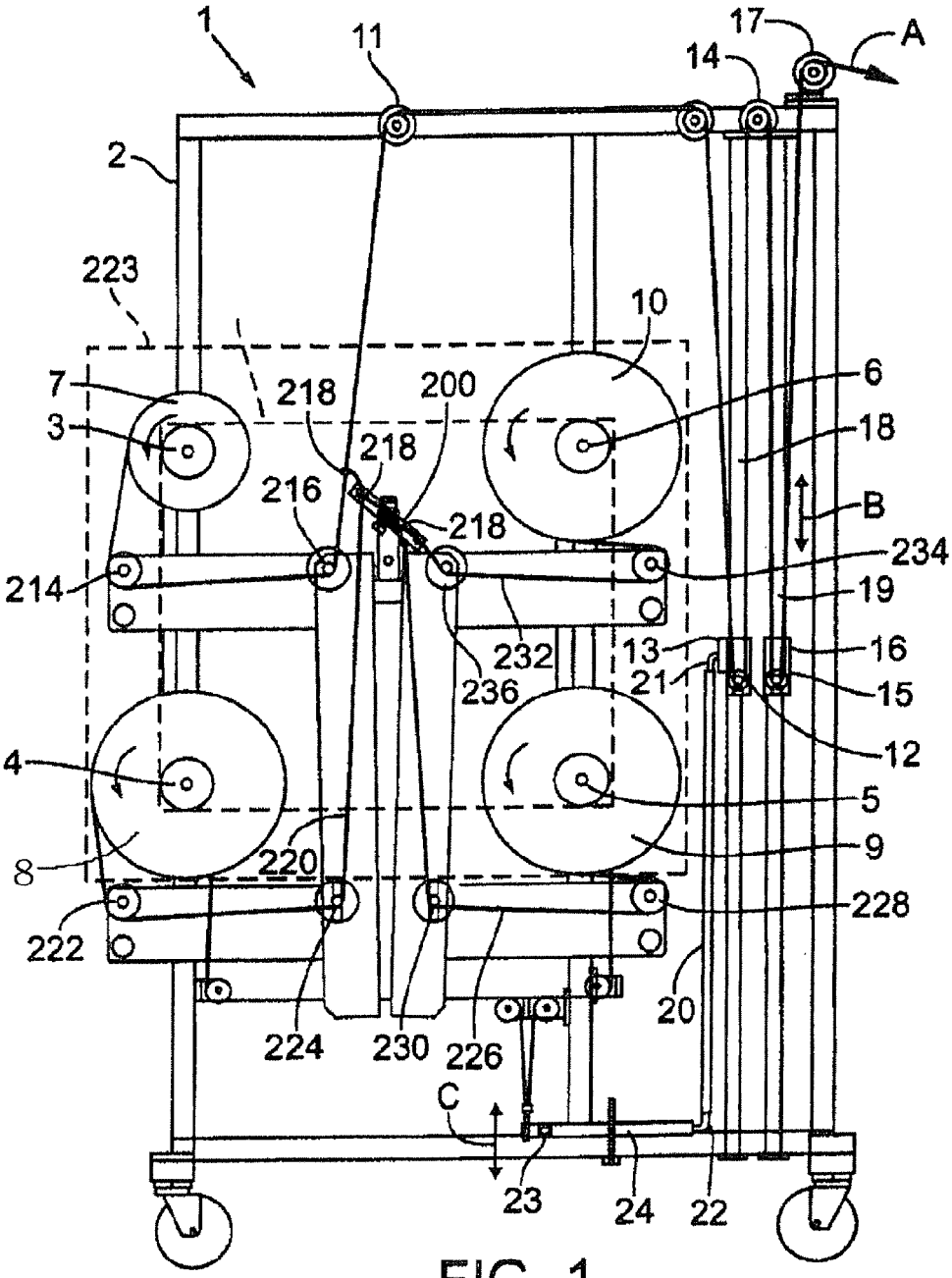
FIG. 1 is a side elevation view of a dispensing apparatus, according to one embodiment.

Referring to FIG. 1, there is shown a schematic illustration of a dispensing apparatus, indicated generally at 1, for dispensing elongated material from a roll, or spool, of the material. The embodiments of dispensing apparatus disclosed herein are preferably, but not exclusively, used for dispensing tape. Accordingly, the embodiments of dispensing apparatus disclosed herein can be used to dispense other types of elongated material from rolls, such as, paper, rope, fabric, or string, to name a few.

Apparatus 1 in the illustrated embodiment includes a frame 2. Mounted on the frame 2 for rotational movement are a first spindle 3, second spindle 4, third spindle 5, and fourth spindle 6. The first spindle 3 supports a first spool of tape 7, the second spindle 4 supports a second spool of tape 8, the third spindle 5 supports a third spool of tape 9, and the fourth spindle 6 supports the fourth spool 10 of tape. Tape from one of the first, second, third, and fourth spools 7, 8, 9, 10 is routed over a fixed roller 11, down to a tensioning roller 12 of a tension-control mechanism 13, over a fixed roller 14, down to a tensioning roller 15 of a tension-control mechanism 16, and over a fixed roller 17 and then is fed to downstream equipment (e.g., corrugator or packaging equipment), as indicated by arrow A.

In the illustrated embodiment, apparatus 1 is shown dispensing tape from the first spool 7. When the tape from the first spool 7 is depleted, the trailing end portion of the tape from the first spool 7 can be spliced to the leading end portion of the tape from the second spool 8; when the tape from the second spool 8 is depleted, the trailing end portion of the tape from the second spool 8 can be spliced to the leading end portion of the tape from the third spool 9; and when the tape from the third spool 9 is depleted, the trailing end portion of the tape from the third spool 9 can be spliced to the leading end portion of the tape from the fourth spool 10 to provide a continuous feed of tape.

While tape is being dispensed from the fourth spool 10, new, full spools of tape can be loaded onto each of the third spindle 5, the second spindle 4, and the first spindle 3. The leading end portion of the tape from the new spool on the third spindle 5 can then be spliced to the trailing end portion of tape from the fourth spool 10 (which is on the fourth spindle 6); the leading end portion of the tape from the new spool on the second spindle 4 can then be spliced to the trailing end portion of tape from the new spool on the third spindle 5; and the leading end portion of the tape from the new spool on the first spindle 3 can then spliced to the trailing end portion of tape from the new spool on the second spindle 4.

After reloading the first, second, and third spindles 3, 4, 5, the system can proceed with dispensing tape from the fourth spindle 6. The tape can then be dispensed as described above, except that the tape dispenses from one spindle to another in reverse order from that described above. For example, after the tape from the fourth spindle 6 is dispensed, the trailing end portion of the tape from spool on the fourth spindle 6 can be spliced to the leading end portion of the tape from the new spool on the third spindle 5. After tape from the new spool on the third spindle 5 is dispensed, the trailing end portion of the tape from the spool on the third spindle 5 can be spliced to the leading end portion of the tape from the new spool on the second spindle 4. After tape from the spool on the second spindle 4 is dispensed, the trailing end portion of the tape from the spool on the second spindle 4 can be spliced to the leading end portion of the tape from the new spool on the first spindle 3. While tape is being dispensed from the new spool on the first spindle 3, new, full spools of tape can be loaded onto each of the second spindle 4, the third spindle 5, and the fourth spindle 6.

Thus, when there is only tape from one spool remaining, the other three spindles can receive new, full spools of tape. This process can be repeated as necessary with any number of spools.

Any suitable splicing technique can be implemented in the embodiments of dispensing apparatus described herein to splice the trailing end portion of one spool of tape to the leading end portion of a succeeding spool of tape. For example, the systems and methods disclosed herein can be used with various obstacle and obstacle catching systems and methods, which permit splicing of tape from two different spools. For example, one such obstacle and catching mechanism is disclosed in U.S. Pat. No. 4,917,327, the entire disclosure of which is incorporated herein by reference. As described in the '327 patent, the rolls of material can be spliced via an obstacle and passageway means that include a pin and loop from a piece of string or similar material. U.S. Patent Publication No. 2007/0018030, the entire disclosure of which is also incorporated herein by reference, discloses another example of an obstacle and catching system for splicing tape from two different spools together. Instead of a simple loop formed by a string, the catching mechanisms disclosed in U.S. Patent Publication No. 2007/0018030 include relatively more rigid, self-supporting materials such as plastic that may be opened or closed.

As used herein, the phrase "automatic splicing" or "automatically splicing" refers to splicing operations in which the trailing end portion of a first spool is caused to splice to the leading end portion of a second spool while substantially maintaining the rate at which tape is supplied to downstream equipment.

The tension-control mechanisms 13 and 16 (or guide members) are movable in two directions (upwardly and downwardly, as indicated by double-headed arrow B, in the illustrated embodiment) along upright rails 18, 19 to vary the path length of the tape in response to changes in tension in the tape. The tension-control mechanisms 13 and 16 are pulled downwardly by an elongated biasing member 20 and upwardly by the tension in the tape. Thus, when tape tension is high (i.e., when the current spool is providing tape slower than is required by downstream equipment, such as at the beginning of a spool), the tension-control mechanism is elevated. The upward movement of the tension-control mechanisms 13 and 16 shortens the tape path so that tape can be fed to downstream equipment without requiring the spool to dispense a corresponding length contemporaneously. Conversely, when tape tension is low (i.e., when the current spool is providing tape faster than is required by downstream equipment), the biasing member 20 causes the tension-control mechanisms 13 and 16 to assume a lower position to increase the length of the tape path.

In particular embodiments, the biasing member 20 is a piece of elastic material, such as an elastic hose (e.g., surgical tubing), although other elastic materials can be used, such as an elastic band or equivalent devices. The illustrated biasing member 20 has a first end 21 connected to the tension-control member 13 and a second end 22 secured to lever 24. Lever 24 is mounted for pivoting movement about a pivot pin 23, as indicated by double-headed arrow C.

Figure 3:
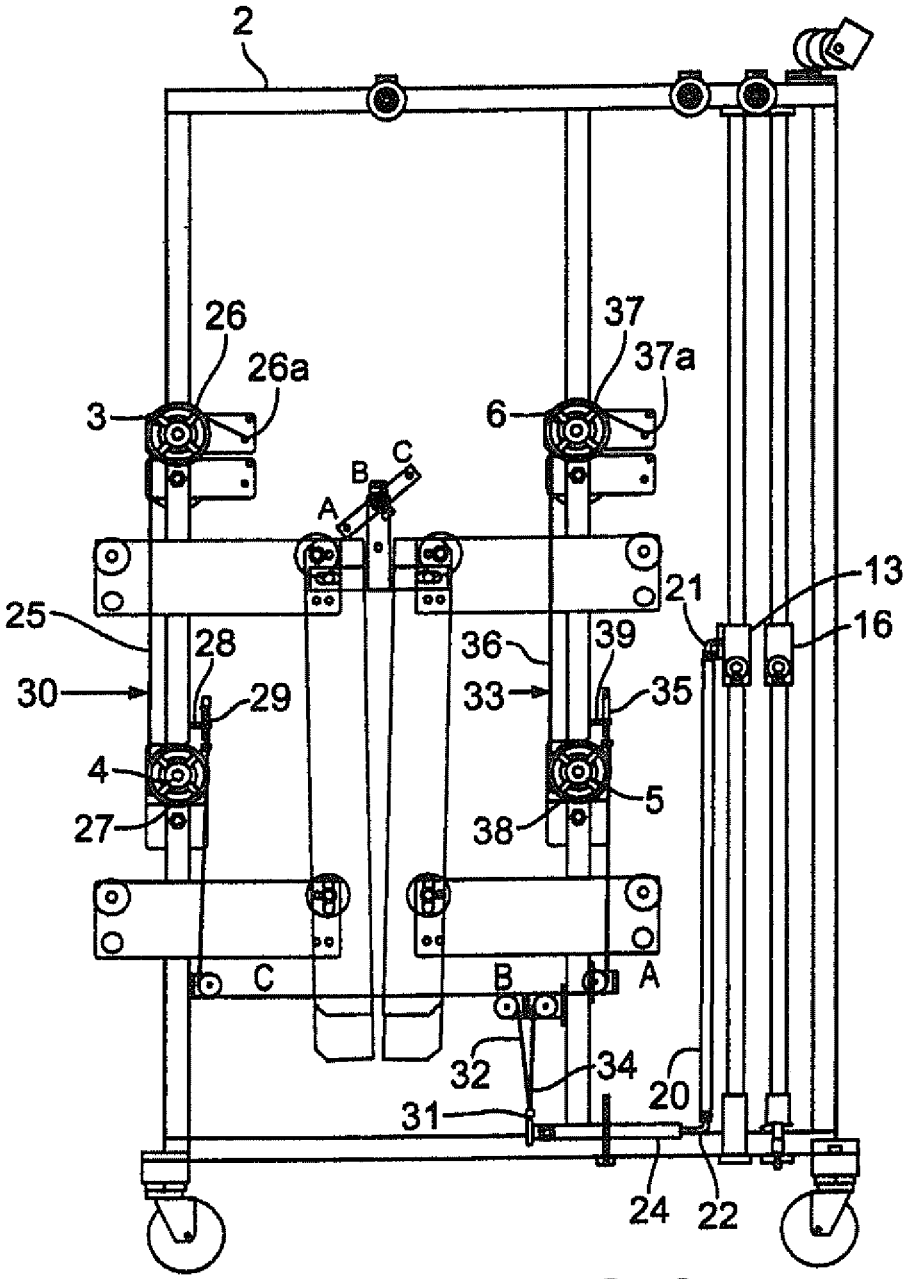
FIG. 3 is an enlarged side elevation view of one of the dispensers of the apparatus of FIG. 2.

Referring to FIG. 3, a brake assembly 30 applies a controlled braking force to the first and second spindles 3, 4, respectively. The brake assembly 30 in the illustrated configuration includes a brake band 25 that extends about portions of spindles 3, 4 and serves to retard their rotation. An upper end portion 26 of the band 25 is affixed to the frame, as at 26*a*, and therefore is stationary. A lower end portion 27 of the band 25 is coupled to extension 28 of frame 2 by a spring 29. Spring 29 exerts a biasing force on band 25 that causes the band to apply a quiescent braking force to the spindles 3, 4. In the illustrated embodiment, for example, the spring 29 is a compression spring and is operable to push upwardly on the lower end portion 27 of band 25 to cause the band 25 to tighten around spindles 3, 4. In alternative embodiments a tension spring can be used to apply a braking force to the spindles. In addition, biasing mechanism other than springs can be used to tension the brake band around the spindles, as noted above.

A similar brake assembly 33 can also be used to apply a controlled braking force to the third and fourth spindles 5, 6, respectively. The brake assembly 33 in the illustrated configuration includes a brake band 36 that extends about portions of spindles 5, 6 and serves to retard their rotation. An upper end portion 37 of the band 36 is affixed to the frame, as at 37*a*, and therefore is stationary. A lower end portion 38 of the band 36 is coupled to extension 39 of frame 2 by a spring 35. Spring 35 exerts a biasing force on band 36 that causes the band to apply a quiescent braking force to the spindles 5, 6. In the illustrated embodiment, for example, the spring 35 is a compression spring and is operable to push upwardly on the lower end portion 38 of band 36 to cause the band 36 to tighten around spindles 5, 6. In alternative embodiments a tension spring can be used to apply a braking force to the spindles. In addition, biasing mechanism other than springs can be used to tension the brake band around the spindles. Such biasing mechanism can include, for example, a piece of elastic material, such as an elastic band or hose, or any of various other elastic or resilient articles.

The lower end portions 27 and 38 of bands 25 and 36, respectively, are coupled to a first end portion 31 of the lever 24 by connecting members 32 and 34. Connecting members 32 and 34 can be formed of various materials and can be, for example, steel cables. The brake assemblies 30 and 33, lever 24, tension-control mechanisms 13 and 16, and biasing member 20 cooperate to form a feedback mechanism, by which the brake assemblies 30 and 26 applies a controlled braking force in response to changes in the tension in the tape. More specifically, when tape tension is high, the tension-control mechanisms 13 and 16 travels upwardly, which in turn causes a second end 22 of the lever 24 to move upwardly and the first end 31 of the lever 24 to move downwardly. This movement is coupled to the brake assemblies 30 and 33 by connecting members 32 and 34, which pulls against the springs 29 and 35, thereby reducing tension in the brake bands 25 and 36 and causing a decrease in braking force so that the dispensing of tape can be accelerated. Conversely, when tape tension is lowered, the tension-control mechanisms 13 and 16 travels downwardly under the biasing force of biasing member 20, which in turn allows the first end 31 of the lever 24 to move upwardly. This motion permits the springs 29 and 35 to reapply more tensioning force to the brake bands 25 and 36, thereby causing a corresponding increase in the braking force to reduce the rate at which tape is being dispensed.

Referring again to FIG. 1, when the first spool 7 becomes depleted of tape, splicing the trailing end of the tape from the first spool 7 to the leading end of the tape from the second spool 8 will automatically bring the second spool 8 into action. The feedback mechanism serves to control the braking force in response to tension spikes that can occur during and immediately following splicing. For example, since the second spool 8 cannot immediately supply tape at the rate required by downstream equipment (due to the inertia of the second spool 8), the tension in the tape suddenly increases. The increased tension causes the tension-control mechanisms 13 and 36 to move upwardly, which in turn causes the brake assemblies 30 and 33 (FIG. 3) to reduce the braking force to allow rotation of the second spool 8. Also, the upward movement of the tension-control mechanisms 13 and 16 shortens the tape path, thereby providing tape to the downstream equipment without requiring the second spool 8 to dispense a corresponding length contemporaneously.

As the second spool 8 accelerates to the required speed, the tension in the tape decreases, thereby allowing the tension-control mechanisms 13 and 16 to be pulled downwardly by the biasing member 20. This movement activates the brake bands 30 and 33 (FIG. 3), which applies a gradually increasing braking force on the second spindle 4 in response to the decrease in tape tension until equilibrium is established.

The diameter of the tape on the spool decreases as tape is removed (dispensed) from the spool. The feedback mechanism provided by the brake assemblies 30 and 33, lever 24, tension-control mechanisms 13 and 16, and biasing mechanism 20 compensates for the diametrical change of the spool by gradually decreasing the braking force to ensure substantially uniform tension during the dispensing of an entire roll. Without such a feedback system, the tension in the tape would increase in proportion to the change in radius of the spool from which the tape is dispensed.

Referring to FIG. 1, if, following a splicing operation, the second spool 8 accelerates beyond the rate at which tape is being pulled by the downstream equipment, slack can form in the second spool 8. The slack can become stuck to the spool, entangled with the tape path, and/or cause tape breakage, which then requires a stoppage in production to fix the problem. This phenomenon is known as "overrun." Thus, to prevent such overrun of the second spool following a splice, the brake bands must provide a braking torque that is sufficient to prevent the second spool 8 from accelerating beyond the rate at which tape is being pulled by the downstream equipment. It can be appreciated that increasing the rate at which tape is dispensed requires a corresponding increase in available braking torque to prevent over-acceleration of a spool following a splicing operation.

However, if the braking torque on a spindle is too high, the upward pulling force of the tension-control mechanisms 13 and 16 (caused by an increase in tension) may not be sufficient to overcome the spring 29 to permit the spindle to accelerate to the required speed. Hence, the braking torque desirably should be great enough to prevent over-acceleration at a desired dispensing rate without adversely affecting the ability of the system to overcome the biasing mechanism (e.g., spring 29) that retards rotation of the spindles.

In particular embodiments, the brake bands (e.g., brake bands 25 and 36) can be configured to apply a maximum braking torque of about 30 to 100 in-lbs., with 40 in-lbs. being a specific example. Embodiments having a braking torque of up to 100 in-lbs. have been found to permit splicing at dispensing rates up to about 1500 feet per minute. The ability to provide an increased braking torque is a consequence of coupling the biasing member 20 to the lever 24. More specifically, biasing member 20 pulls upwardly on the second end 22 of lever 24 when the tension-control mechanisms 13 and 16 are pulled upwardly in response to an increase in tape tension. The pulling force of biasing member 20 on the lever 24 is greater than the upward pulling force that the tape exerts on the tension-control mechanisms 13 and 16. In this manner, tension-control mechanisms 13 and 16 serves as a force divider for reducing the force that is transferred to the lever 24 from the tension-control mechanisms 13 and 16 by the biasing member 20. Hence, the mechanical advantage provided by two tension-control mechanisms 13 and 16 can be used to compensate for an increase in braking torque over prior systems.

Figure 2:
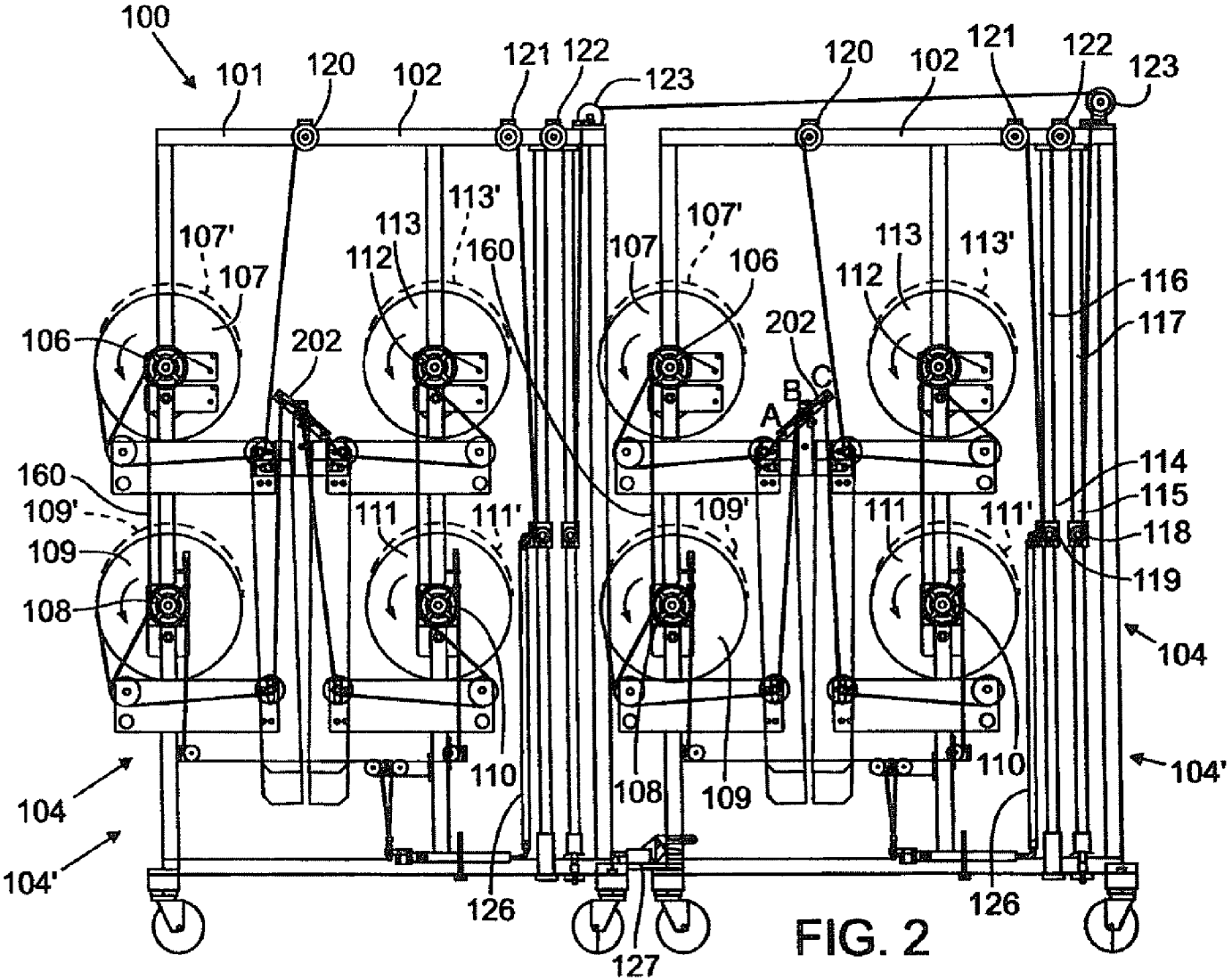
FIG. 2 is a side elevation view of a dispensing apparatus, according to one embodiment, for dispensing tape from multiple dispensers.

Apparatus 1 is desirably constructed so that it is modular. Thus, one or more apparatus 1 can be positioned side-by-side, as shown in FIG. 2. FIG. 2 illustrates two apparatuses (frames 101, 102) connected together or interlocked by a connection device 127. Connection device 127 can comprise any known coupling or securing device, such as a clamp. Thus, apparatus 100 is omni-extendable and any number of frames (dispensing apparatuses) can be connected together to form a single dispensing apparatus. Each individual apparatus 1 can be configured with rolling members 129 (wheels) to facilitate movement of the individual apparatuses 1, making it easier to position the apparatus side-by-side for coupling.

Referring now to FIG. 2, there is shown an apparatus 100 according to one embodiment for simultaneously dispensing tape from multiple rolls. Apparatus 100 includes two frames 101, 102 on which each have mounted two tape dispensers. Each of frames 101 and 102 (and related structure) comprises a dispensing system constructed similarly to the dispensing apparatus 1 disclosed in FIG. 1. In the illustrated configuration, two such dispensers, indicated at 104, are mounted on one side of the frames 101, 102, and two dispensers, indicated at 104', are mounted on the opposite side of frames 101, 102 (which are generally hidden from view in FIG. 1).

Figure 4:
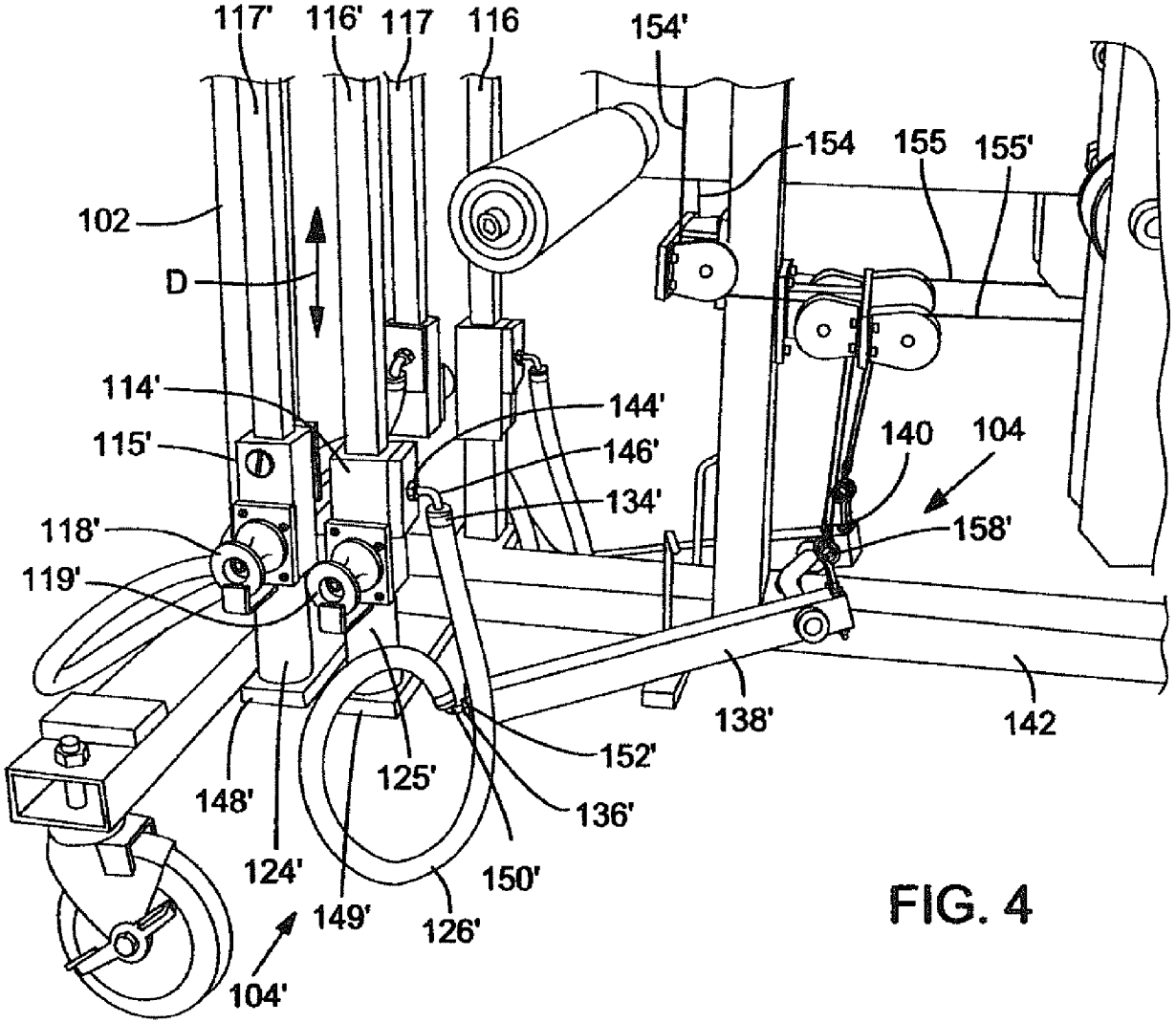
FIG. 4 is a partial, perspective view of the bottom portion of two side-by-side dispensers of the apparatus of FIG. 2, as viewed from above.

In alternative embodiments, apparatus 100 can have additional dispenses mounted onto another side of frames 101 and 102. Thus, each dispenser 104 can also be mounted in a side-by-side relationship with an adjacent dispenser 104'. Components of dispensers 104' that are identical to corresponding components of dispensers 104 are given the same respective reference numerals, except that the reference numerals for the components of dispensers 104' are followed by an apostrophe ('). As shown in FIGS. 2 and 4 each dispenser 104 includes first, second, third, and fourth rotatable spindles 106, 108, 110, and 112, respectively, mounted to the frames 101 and 102. The first spindle 106 supports a first spool of tape 107, the second spindle 108 supports a second spool of tape 109, the third spindle 110 supports a third spool of tape 111, and the fourth spindle 112 supports a fourth spool of tape 113. Dispensers 104' have respective first, second, third, and fourth spindles 106', 108', 110', and 112' for supporting respective first, second, third, and fourth spools 107', 109', 111' and 113' on the opposite side of frames 101, 102.

As best shown in FIG. 4, each dispenser 104, 104' also includes respective tension-control mechanisms 114, 114', 115, 115' that ride on respective upright rails 116, 116', 117, 117' extending between the top and bottom portions of the frames 101, 102. As shown in FIG. 4, each rail 116', 117' of a dispenser 104' (and rails 116, 117 of an adjacent dispenser 104) are mounted on opposite ends of a transverse member 148', 149' of the frame. Tension-control mechanisms 114, 114', 115, 115' are movable upwardly and downwardly along their respective rails 116, 116', 117, 117' as indicated by double-headed arrow D in FIG. 4. Each tension-control mechanism 114, 114', 115, 115' includes respective tensioning rollers 118, 118', 119, 119'.

As shown in FIG. 2, tape that is dispensed from the first spool 107 of a dispenser 104 is routed over fixed rollers 120, 121 down to a tensioning roller 119 of a respective tension-control mechanism 114, and over a respective fixed roller 122, down to a tensioning roller 118 of a respective tension-control mechanism 115, and over a respective fixed roller 122 to define a tape path T. Tape from the first spools 107 can be spliced to tape from respective second spools 109 to provide a continuous feed of tape from each dispenser 104. Although not shown, tape from each dispenser 104' can be reeved in the same manner over a respective tensioning roller 118', 119" and a set of fixed rollers (not shown).

As best shown in FIG. 4, each rail 116, 116', 117, 117' in the illustrated configuration can comprise elongated tubing having a substantially square cross-section, although rails having other cross-sectional shapes also can be used. Stops 124, 124', 125, 125' (which can be a piece of rigid tubing) can be placed at the bottom of rails 116, 116', 117, 117' to limit the downward travel of tension-control mechanisms 114, 114', 115, 115'. Elastic biasing members 126, 126' (which can be elastic hose or tubing, such as surgical tubing) provide biasing forces for biasing tension-control mechanism 114, 114' downwardly against the tension in the tape. Biasing members 126, 126' have first ends 134, 134' coupled to tension-control members 114, 114' and second ends 136, 136' coupled to lever 138, 138' of frame 102.

Biasing members 126, 126' can be coupled to tension-control members 134, 134', respectively, and to levers 138, 138' in any suitable manner. As shown in FIG. 4, for example, the first ends 134, 134' of biasing members 126, 126' are placed on male inserts 144, 144' and secured with hose clamps 146, 146'. Second ends 136, 136' of biasing members 126, 126' are secured with hose clamps 152, 152' to opposite ends of a rod 150, 150' that extends through extension 138, 138'.

As shown in FIG. 4, each lever 138' of an adjacent dispenser 104' (and each lever 138 of a dispenser 104) can be pivotally mounted on opposite ends of a common pivot pin 140. Pivot pin 140 is mounted to a longitudinal member 142 of frame 102 extending between the dispensers 104 and 104'. Lever 138 and lever 138' are configured to pivot independently relative to each other about pivot pin 140. Levers 138, 138' can be configured to extend at an angle from the longitudinal member 142 (as shown in FIG. 4 of U.S. Pat. No. 7,007,883, which has been incorporated herein by reference).

Figure 5:
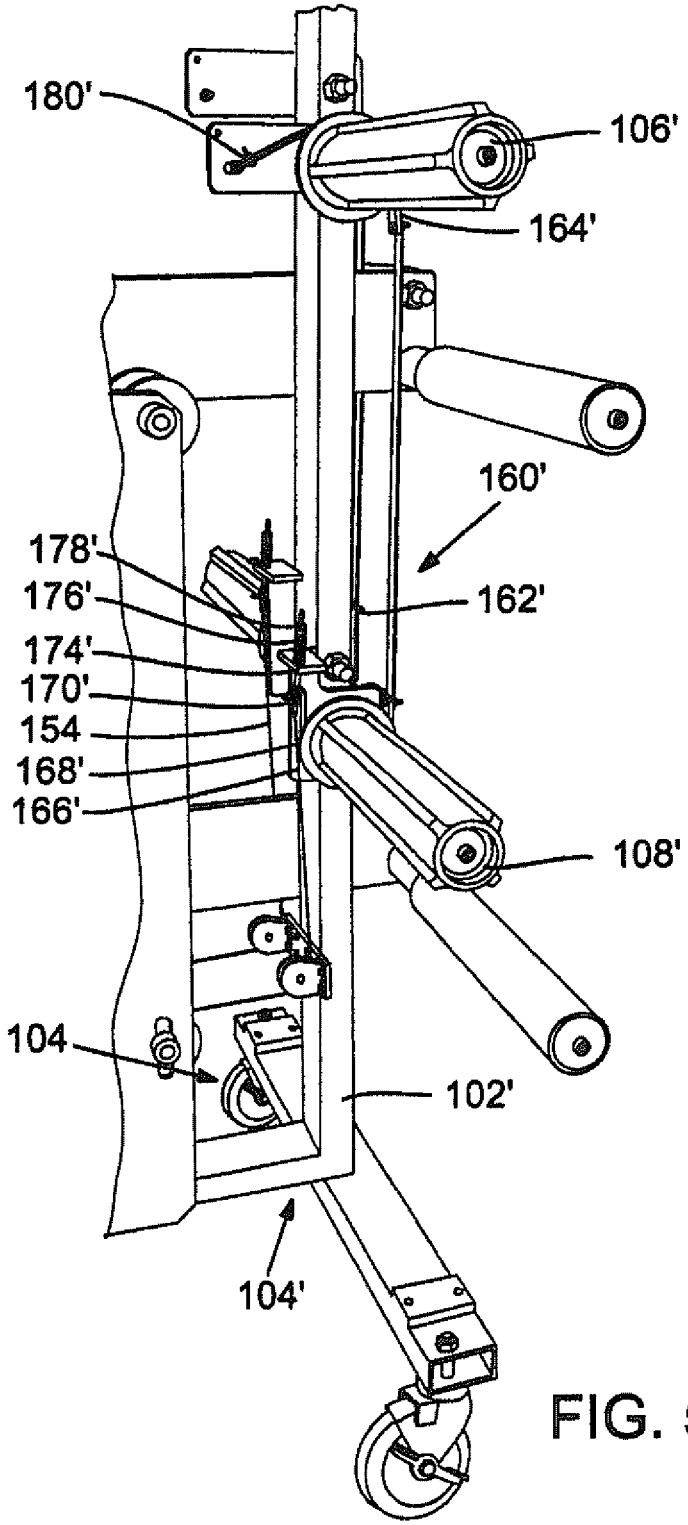
FIG. 5 is a partial, perspective view of a portion of two side-by-side dispensers of the apparatus of FIG. 2, illustrating the upper and lower spindles and the brake assemblies of two side-by-side dispensers.

As shown in FIG. 2, each dispenser 104 has a brake assembly 160 (or 160') operatively connected to a respective biasing member 126 (or 126') to provide a controlled braking force to spindles 106, 108, 110, 112 (or 106', 108', 110', 112') in response to changes in tension in the tape. As best shown in FIG. 5, each brake assembly 160' can have a brake band 162' having an upper end portion 164' that extends about a portion of a respective first spindle 106' and a lower end portion 166' that extends about a portion of a respective second spindle 108'. The upper end portion 164' of brake band 162' can be affixed to frame 102' with a bolt 180'. The inner surfaces of upper end portion 164' and lower end portion 166' may be lined with a suitable brake lining material 168' (e.g., Scan-Pac 232 AF, available from Scan-Pac Manufacturing of Mequon, Wis.) for contacting the surfaces of spindles 106', 108'.

As best shown in FIG. 5, a threaded rod 170' can be connected to lower end portion 166' of brake band 162' and extend upwardly through a bracket 172' on frame 102'. A compression spring 174' can be disposed around rod 170' and supported by bracket 172'. A washer 176' and a nut 178' on rod 170' can be tightened against the spring 174' to preload, or pre-compress, the spring 174'. As can be appreciated by FIG. 5, pre-compression of spring 174' causes the spring to exert a biasing torque that pulls upwardly on the lower end portion 166' of brake band 162', which in turn applies a braking torque to spindles 106', 108'. In particular embodiments, the brake band applies a maximum braking torque of at least 30 in-lbs.

to spools 106', 108'. A downward pulling force on rod 170' compresses spring 174' to relieve tension in the brake band 162', thereby reducing the braking torque on spindles 106', 108'.

In use, tension spikes, which can occur following splicing, can transfer excessive forces to the spring 174', causing damage or failure of the spring due to over-actuation. A stop mechanism may be provided to prevent such over-actuation of the spring. For example, a rigid sleeve can be disposed on rod 170' between bracket 172' and washer 176'. Compression of the spring 174' therefore is limited to the distance between the washer 176 and the adjacent end of the sleeve. In this manner, the sleeve and washer 176' serve as a stop mechanism to prevent over-actuation of the spring 174'.

Each dispenser 104 (104') can have a similarly configured brake assembly, which is shown in FIG. 5 and discussed in more detail above, for applying a braking force to respective spindles 106, 108 (106', 108').

As shown in FIG. 4, connecting members 154, 154', 155, 155' are connected at their lower ends to the second end portions 158, 158' of levers 138, 138'. As shown in FIG. 5, connecting members 154, 154' are connected at their upper ends to the lower end portions 166, 166' of brake bands 162, 162'. In working embodiments, connecting members 154, 155 (and 154', 155') may be steel wires or cables.

Dispensers 104, 104' can operate in a manner similar to the embodiment shown in FIG. 1. For example, an increase in tape tension causes the end portion 158 (158') of lever 138 (138') to pivot downwardly, which causes connecting members 154, 155 (154' 155') to pull downwardly on the lower end portion 166 (166') of a respective brake band 160 (160') against spring 174 (174'). This movement reduces tension in the brake band to cause a reduction in braking force applied to spindles 106, 108 (106', 108'). Conversely, a decrease in tape tension permits end portion 158 (158') of lever 138 (138') to pivot upwardly to allow spring 174 (174') to expand, thereby resulting in an increase in braking force applied to the spindles 106, 108 (106', 108'). Hence, tension-control mechanisms 114, 115 (114', 115'), elastic member 126 (126'), and brake assembly 160 (160') cooperate to form a feedback mechanism to provide a controlled braking force in response to changes in tape tension.

As shown in FIGS. 6A and 6B of U.S. Pat. No. 7,007,883 (which has been incorporated by reference herein) and described in detail in U.S. Pat. No. 7,007,883, braking systems used connection with a tension-control mechanism in a feedback system, can reduce tension in the tape paths and increase efficiency of the tape dispensing system.

Figure 6:
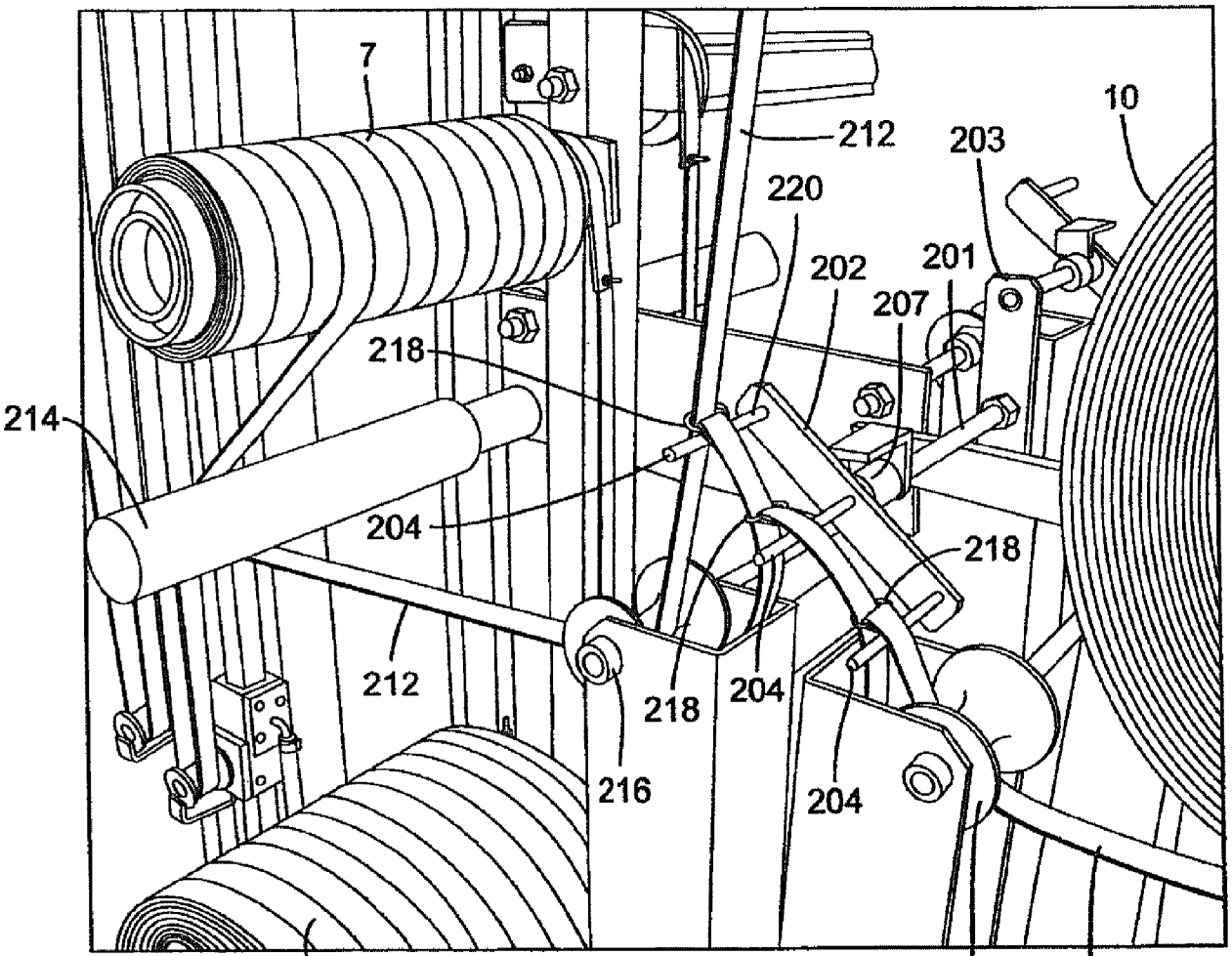
FIG. 6 is a partial, perspective view of a portion of an apparatus for dispensing tape.

Referring again to FIG. 1, a support member 200 can be provided to collect and/or support a portion of the staged spools (rolls) of tape. Support member 200 can be formed in a variety of configurations and shapes. For example, as shown in FIG. 6, support member 200 can comprise a bar 202 with a plurality of extension members (or pins) 204 that extend from the bar 202. Support member 200 can be attached to any structural element of the apparatus 1. For example, as shown in FIG. 6, support member 200 can be attached to a rod 201, which is coupled to a vertical element 203.

Each bar 202 can be configured to support a leading end portion of a staged spool of tape. For example, as shown in FIGS. 1 and 6, tape 212 from a first spool 7 is being dispensed by the dispensing apparatus 1. Tape 212 is pulled (or otherwise positioned) around fixed roller 214 and then around fixed roller 216. After passing roller 216, tape 212 is passed through (or otherwise positioned near) a catching mechanism 218 associated with a leading end portion of tape 220 from the second spool 8. After passing through catching mechanism 218, tape 212 travels upwards and over fixed roller 11, as described above.

Catching mechanism 218 can be any kind of catching mechanism, including a loop as described in U.S. Pat. No. 4,917,327 (which has been incorporated by reference herein) or another flexible member as described in U.S. Patent Publication No. 2007/0018030 (which has also been incorporated by reference herein). Catching mechanisms 218 can be integrated with (or otherwise attached to or associated with) a leading end portion of tape from the staged spools.

The relative positions of tape from the three staged spools will now be discussed. Tape 220 from the second spool 8 is pulled (or otherwise positioned) around fixed roller 222 and then around fixed roller 224. After passing roller 224, the leading end portion of tape 220 passes over one of the extension members 204 and terminates at the catching mechanism 218 associated with tape 220. Catching mechanism 218 desirably surrounds at least a portion of tape 212. Since the leading end portion of tape 220 passes over one of the extension members 204 (desirably, the extension member positioned on the left in FIG. 6), the leading end portion of tape 220 rests on that extension member 204, which substantially prevents the leading end portion of tape 220 from contacting and being prematurely pulled downstream with the running tape. At the end of the first spool 7, an obstacle engages catching mechanism 218 to form a splice and pull tape 220 downstream into motion.

Tape 226 from the third spool 9 is pulled (or otherwise positioned) around fixed roller 228 and then around fixed roller 230. After passing roller 228, the leading end portion of tape 226 passes over another of the extension members 202 (desirably, the extension member positioned in the center in FIG. 6) and terminates at the catching mechanism 218 associated with tape 226. The catching mechanism 218 associated with tape 226 desirably surrounds a portion of tape 220, which substantially prevents lateral movement of the leading end portion of tape 226. Also, since the leading end portion of tape 226 passes over one of the extension members 204, the leading end portion of tape 226 rests on that extension member 204, which substantially prevents the leading end portion of tape 226 from contacting the tape 220 from the second spool and being prematurely pulled downstream by the tape 220 (when the second spool 8 becomes active). At the end of the second spool 8, an obstacle of the second spool engages catching mechanism 218 to form a splice and pull tape 226 downstream into motion.

Tape 232 from the fourth spool 10 is pulled (or otherwise positioned) around fixed roller 234 and then around fixed roller 236. After passing roller 236, the leading end portion of tape 232 passes over another of the extension members 204 (desirably, the extension member positioned on the right in FIG. 6) and terminates at the catching mechanism 218 associated with tape 232. The catching mechanism 218 associated with tape 232 surrounds a portion of tape 226, which substantially prevents lateral movement of the leading end portion of tape 232. Also, since the leading end portion of tape 232 passes over one of the extension members 204, the leading end portion of tape 232 rests on that extension member 204, which substantially prevents the leading end portion of tape 232 from contacting the tape 226 from the third spool 9 and being prematurely pulled downstream of the tape 226 (when the third spool 9 becomes active). At the end of the third spool 9, an obstacle of the third spool engages catching mechanism 218 of the fourth spool to form a splice and pull tape 232 downstream into motion.

When tape is being dispensed from the first spool 7 and spools 8, 9, and 10 are configured as staged (non-active) spools, the support member 200 is generally positioned at an angle from the horizontal. For example, as best seen in FIGS. 1 and 6, bar 202 is desirably angled so that the extension member 204 on the left side of bar 202 (which preferably supports a leading end portion of tape 220 from the second spool 8) is at a position higher than the extension member 204 in the middle of bar 202 (which preferably supports a leading end portion of tape 226 from the third spool 9), and the middle extension member 204 is at a position higher than the extension member 204 on the right side of bar 202 (which preferably supports a leading end portion of tape 232 from the fourth spool 10). By configuring the support member 200 at an angle as shown in FIG. 1 (and as described above) the leading end portions of the staged (non-active) tape spools are positioned at descending heights relative to the order in which the staged tape spools will be put into action, which helps to reduce the likelihood that the various staged tape spools will become unnecessarily entangled with one another.

Support member 200 is also preferably movable, so that the angle of the bar 202 can be adjusted. Small adjustments can be desirable to maintain proper positioning of the extension members 204 relative to the leading end portions of tape (and the related catching mechanisms 218). In addition, support member 200 is preferably movable so that the angle of the bar 202 can be reversed. Support member 200 can be movable in any manner, but is desirably rotatable about a pivot member 207.

As discussed in detail above, the dispensing apparatus shown in FIG. 1 is capable of being operated in at least two configurations. In the first configuration, spool 7 is the active spool and spools 8, 9, and 10 are the staged (non-active) spools. In the second configuration, spool 10 is the active spool and spools 9, 8, and 7 are the staged (non-active) spools.

In the second configuration, the angle of the bar 202 is desirably reversed from that which is shown in FIG. 6, as depicted by the bar 202 of the dispenser on the right side of FIG. 2. That is, in the second configuration, bar 202 is desirably angled so that the extension member 204 on the right side of bar 202 (which preferably supports a leading end portion of tape from the third spool 9) is at a position higher than the extension member 204 in the middle of bar 202 (which preferably supports a leading end portion of tape from the second spool 8), and the middle extension member 204 is at a position higher than the extension member 204 on the left side of bar 202 (which preferably supports a leading end portion of tape from the first spool 7). Thus, when the dispensing apparatus is operating in the second configuration, the support member 200 is desirably at an angle that is opposite that shown in FIG. 1 so that, when the order in which the spools dispense tape is reversed from that shown in FIG. 1, the leading end portions of the staged (non-active) tape spools are still positioned at descending heights relative to the order in which the staged tape spools will be put into action. Thus, the support member 200 can be configured to cascade downward from the active spool to the last staged spool.

Moreover, as shown in FIG. 1, support member 200 can be positioned between at least two spools, such as first spool 7 and fourth spool 10. Desirably, support member 200 is positioned within an outer envelope 223 defined by the outer edges of the material held on each spool of the apparatus (e.g., spools 7, 8, 9, and 10) when those spools are full (e.g., prior to dispensing any tape or material from the spool). For example, in FIG. 1, the outer envelope 223 is represented by a dashed rectangular line. Alternatively, the support member 200 can be contained completely within a smaller outer envelope 227. The smaller outer envelope 227 can be defined by the rectangular perimeter formed by the outer edges of each of the spindles 1, 2, 3, and 4, as shown in FIG. 1. Smaller outer envelope 227 is represented by a dashed rectangular line in FIG. 1.

Support member 200 is desirably positioned within either (or both) the outer envelope 223 and/or smaller outer envelope 227. By positioning support member 200 within either or both outer envelopes 223, 227 it is possible to achieve a relatively small distance from each spool to the support member 200, which not only helps reduce the likelihood that tape from the various spools will interfere with each other, it also simplifies loading of the spools onto the apparatus.

Because of the configuration of support member 200, the length of the system can be significantly reduced. By arranging the leading end portions of tape from stand-by (staged) spools on the support member 200 as described above, two rolls can be positioned underneath two upper rolls rather than spacing all four rolls horizontally along the length of the dispenser. This can result in a length reduction of approximately 50% per 4-cascade splicing station. The support member 200 supports and separates the tapes from the different rolls so that the rolls can be supported in the compact arrangement shown in FIG. 1.

In addition, the support member 200 can be configured to support any number of leading end portions of tape from stand-by spools. Thus, as shown in FIG. 1, the apparatus can be configured to support three stand-by spools. In addition, more or fewer extension members 204 can be used. For example, adding more extension members may allow more tape to be dispensed before it is necessary to add new rolls to the system. In addition, if desired, multiple spools (e.g., three or more) can be used to reduce the size of each spool associated with an extension member, without reducing the total tape output of the dispensing system. Thus, having a plurality of spools can reduce the weight of each spool, which in turn reduces the amount of potential scrap material if there is a spool that has tape defects or other material deficiencies.

Figure 7:
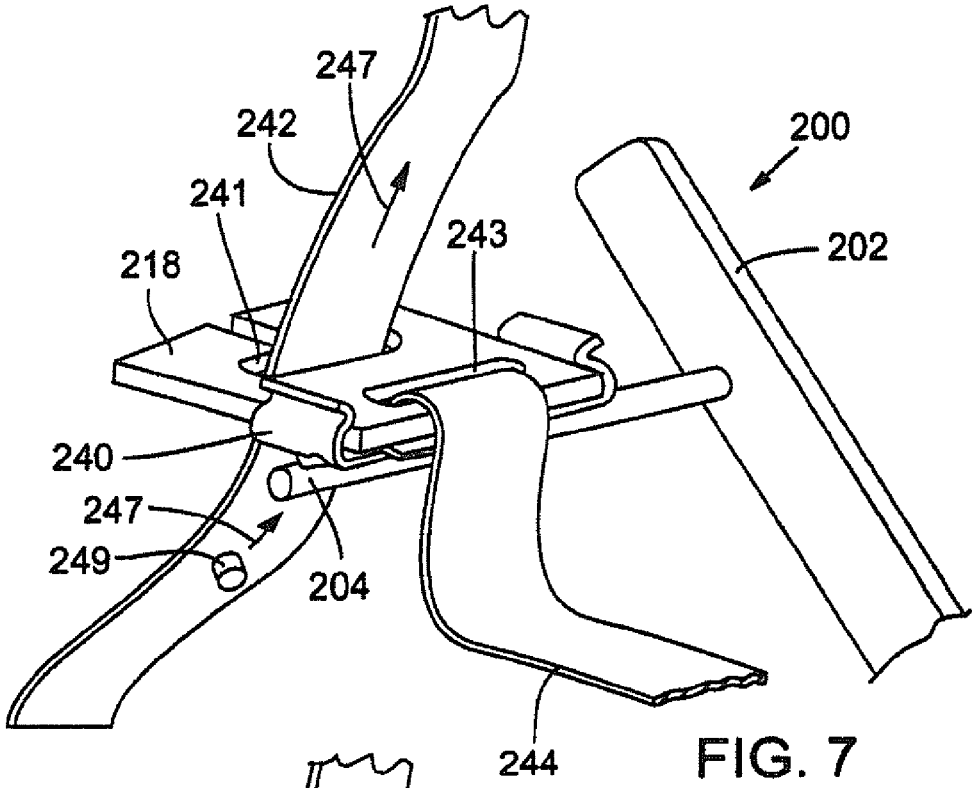
FIG. 7 is a schematic perspective view of a holding member used in conjunction with a support member.

FIG. 6 illustrates the leading end portions of tape from staged spools simply resting upon extension members 204 prior to being dispensed. However, the support member 200 can be configured to support the leading end portions of tape in other ways. For example, if desired, the catching mechanisms 218 associated with the leading end portions of the tape of the staged spools could be positioned directly on the extension members. In addition, the catching mechanisms 218 can be removably (releaseably) attached to the extension members 218. For example, as shown in FIG. 7, a holding member 240 can be coupled to each extension member 204 and configured to temporarily hold the catching mechanisms 218. The securing of the holding member 240 to the extension member 204 can be accomplished via any known attachment method, such as welding, bolting, tethering, etc. Alternatively, holding member 240 can be formed integral with the extension member 204.

As shown in FIG. 6 and as discussed above, a plurality of extension members 204 can be configured to extend outwardly from the bar 202. FIG. 7 shows a portion of a support member 200 that includes a single extension member 204, with the other portions of the support member 200 omitted for clarity. Holding member 240 can comprise a clip or a nest to temporarily retain a catching mechanism 218 (which, in this embodiment, is formed from a relatively rigid, self-supporting material such as plastic). Catching mechanism 218 is coupled to tape 244 from a staged spool (not shown), so that when an obstacle (e.g., obstacle 249) impacts catching mechanism 218, tape 244 from the staged spool is dispensed from the apparatus. An opening 241 can be provided in the catching mechanism 218 to permit tape 242 from the active roll to pass through the catching mechanism 218, as tape 242 moves in the direction shown by arrows 247. In addition, a slot 243 can be provided to couple the leading end portion of tape 244 to the catching mechanism. It should be understood, however, that tape from the active roll can pass through or near the catching mechanism in a variety of ways (so long as the catching mechanism is positioned and/or configured to impact an obstacle to permit the dispensing of tape from a secondary (staged) roll. Also, the leading end portion of tape 244 can be coupled to the catching mechanism in a variety of ways.

Thus, the holding member 240 can hold catching mechanism 218 while tape 242 (which is being actively dispensed) passes through the catching mechanism 218. Holding mechanism 240 can comprise a flexible metal or plastic clip with an opening to receive the catching mechanism 218. Holding member 240 can be sized and configured such that when the catching mechanism 218 is positioned within the opening, the holding member applies an inwardly directed holding force against the sides of the catching mechanism, and the holding force holds the catching mechanism in the opening. The holding force is large enough to hold the catching mechanism 218 in place and prevent premature splicing if imperfections in the running tape 242 pass through and contact the catching mechanism 218. Such imperfections or unintentional obstacles can include, for example, glue "globs" or other irregularities that may impact the catching mechanism. In addition, it is possible that mere friction between the tape and the catching mechanism can cause the catching mechanism to move with the running tape, thereby bringing tape from the staged spool into motion.

The holding force of the holding member 240, however, desirably is less than the force that the catching mechanism 218 encounters when the active spool of tape is depleted and an obstacle impacts the catching mechanism as discussed above. Accordingly, the holding member 240 holds the catching mechanism in position upon extension member 204 until the active spool of tape 242 becomes depleted and the obstacle from the active spool of tape 242 impacts the catching mechanism 218. At that time, the catching mechanism 218 is pulled out of the holding member 240 and tape 244 from the staged spool is dispensed.

Figure 8:
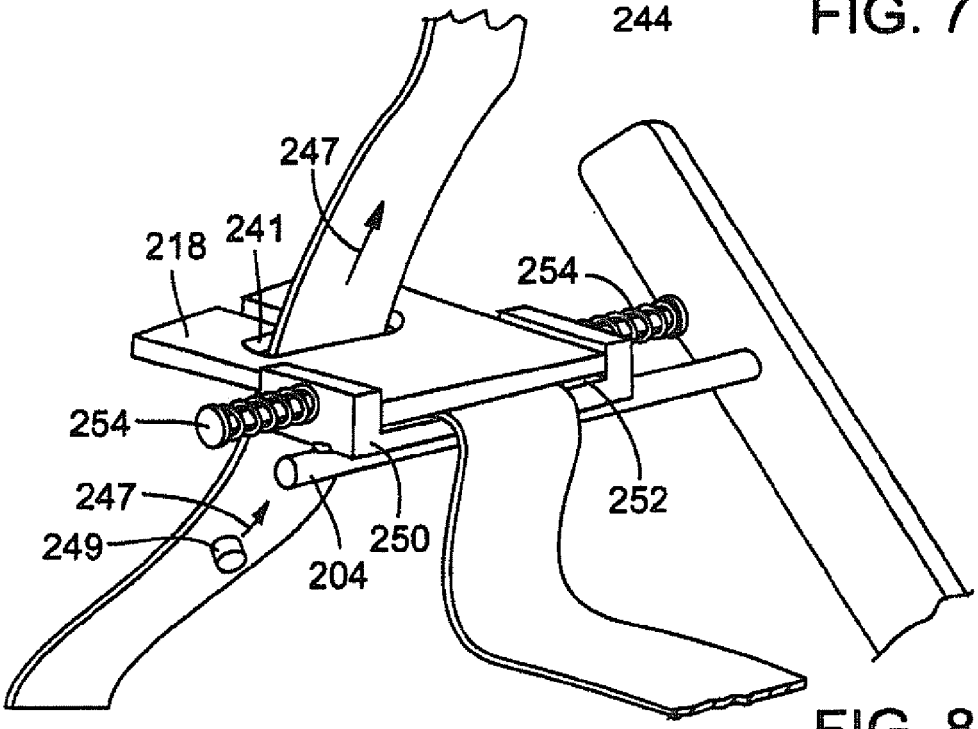
FIG. 8 is a schematic perspective view of a holding member used in conjunction with a support member.

FIG. 8 illustrates another embodiment of a holding member 240 that includes a spring-loaded nest structure. For clarity, the active and staged tape and the support member 200 have been omitted from FIG. 8. However, it should be understood that the general structure of a dispensing apparatus using a holding member 250 as shown in FIG. 8 can be the same as that shown in FIG. 7. For example, tape from an active roll passes through an opening 241 in the catching mechanism 218 and a leading end portion of tape from a staged roll is coupled to the catching mechanism 218 (either to a slot, which is not shown, or otherwise secured to the catching mechanism).

Holding member 250 comprises a catching-mechanism-receiving portion 252 and capturing elements 254. Capturing elements 254 can comprise spring members which are biased to exert a force towards the catching mechanism 218 when it is positioned in the receiving portion 252. The force of the biased capturing elements 254 is desirably sufficient to hold the catching mechanism 218 in receiving portion 252 until an obstacle impacts the catching mechanism 218 to begin dispensing tape from the next staged spool.

Figure 9:
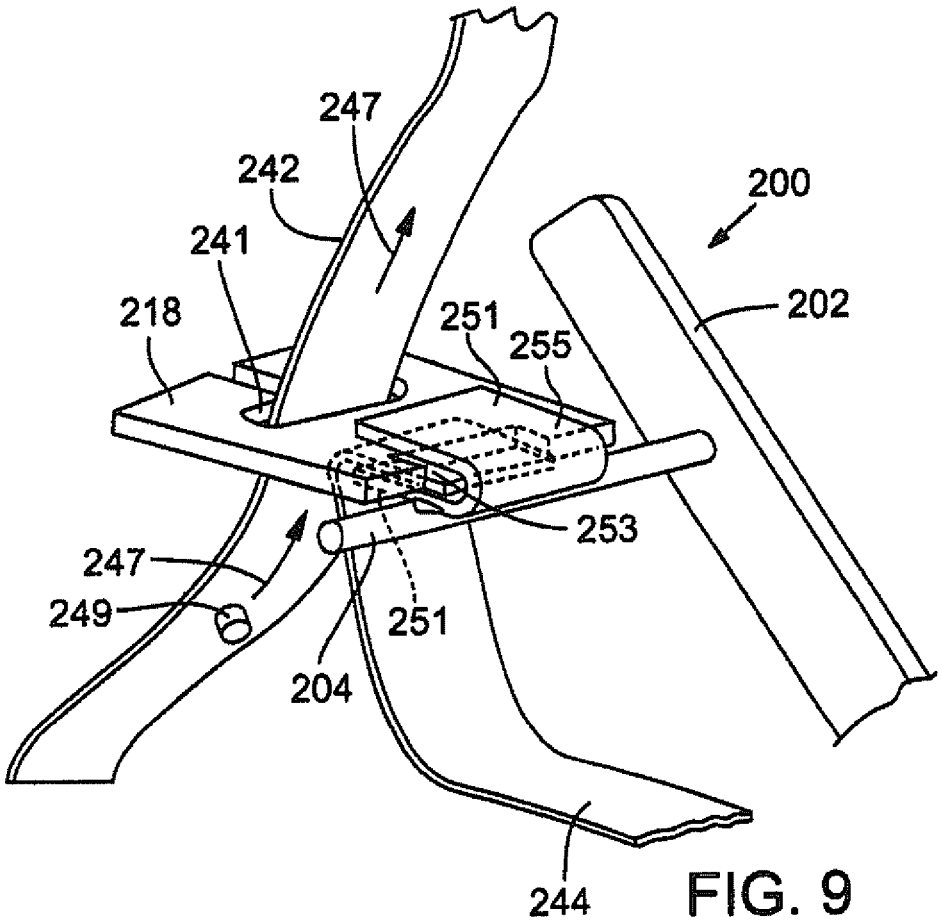
FIG. 9 is a schematic perspective view of a holding member used in conjunction with a support member.

Another example of a holding member 255 is shown in FIG. 9. In FIG. 9, holding member 255 comprises a clip structure that has two leg portions 251 that have inner faces which face each other and which form a holding area 253 between the two inner faces. The leg portions are desirably formed such that the distance between at least a portion of the two inner faces is less than the thickness of at least a portion of the catching mechanism 218. The catching mechanism 218 can be positioned between the two inner faces of the leg portions 251. The leading end portion of tape 244 can be coupled to catching mechanism 218, and drawn into the holding area as shown in FIG. 9.

Thus, when a catching mechanism 218 (associated with tape 242 from the active roll) is positioned between the two inner faces of the leg portions 251, the inner faces contact and hold (at least temporarily) the catching mechanism 218 in the holding area 253. The inwardly directed force of the leg portions 251 contacting the catching mechanism 218 is desirably sufficient to hold the catching mechanism 218 in the holding area 253 until an obstacle impacts the catching mechanism 218 to begin dispensing tape from the next staged spool. When an obstacle impacts the catching mechanism 218, the catching mechanism is pulled from the holding area 254, pulling with it tape 244 from the staged spool.

Figure 10A:
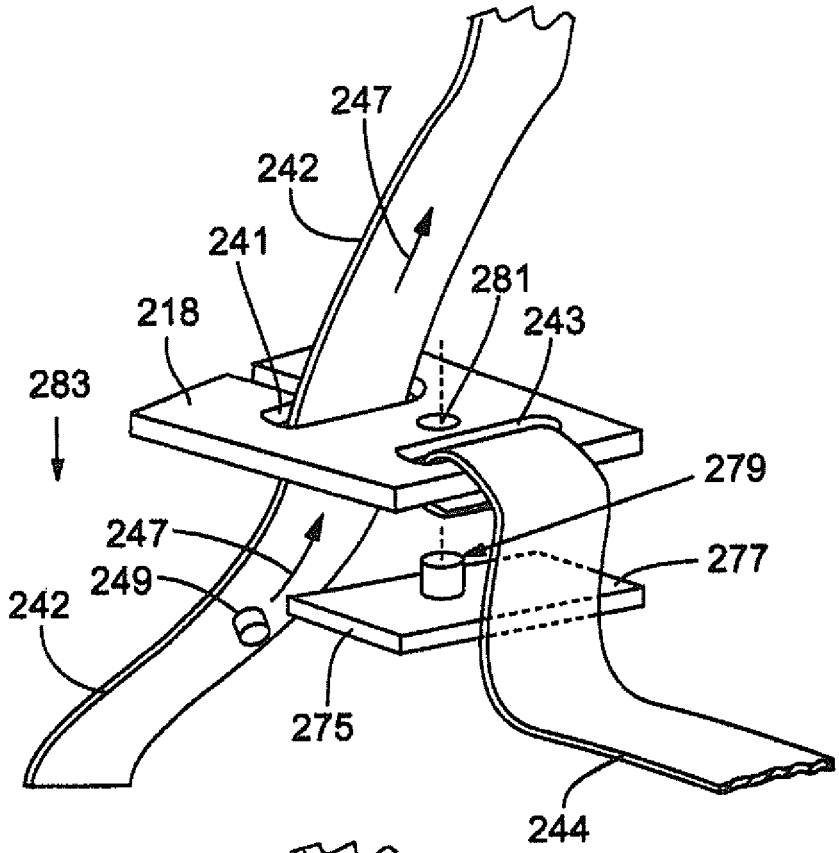
FIGS. 10A and 10B are schematic perspective views of a holding member used in conjunction with a support member.
Figure 10B:
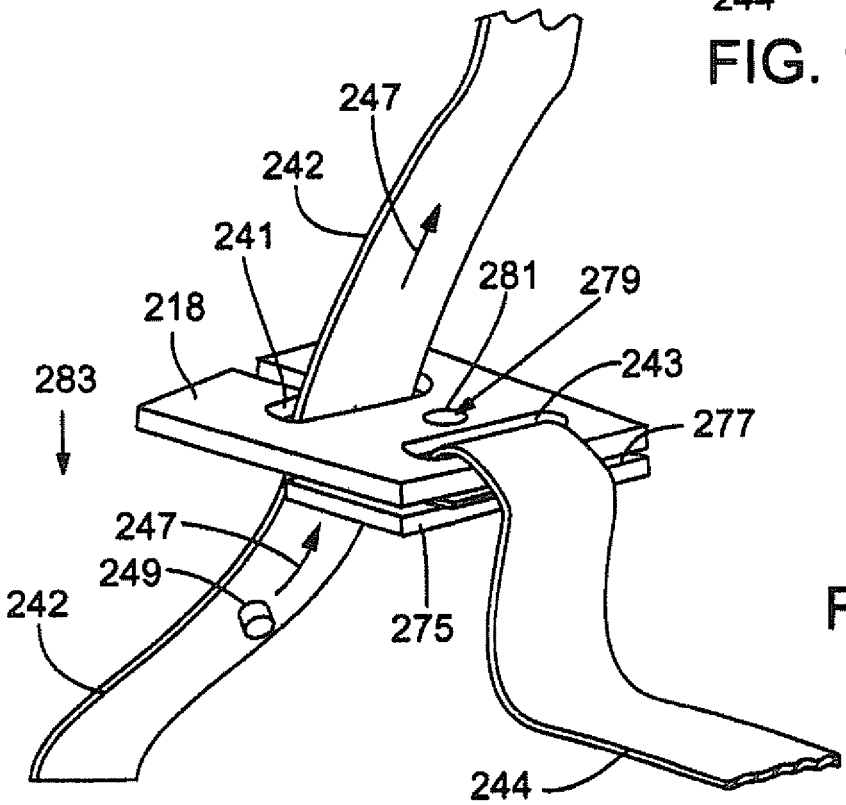

FIGS. 10A and 10B show another embodiment of a holding member 275. Holding member 275 comprises a plate 277 with a pin 279 extending upwardly from the plate 277. Catching mechanism 218 is configured with an opening 281 that corresponds to the shape of the pin 279. As shown in FIG. 10B, catching mechanism 218 can be secured, temporarily, to the holding member 275 by moving catching mechanism 218 over holding member 275, aligning opening 281 with pin 279, and moving catching mechanism 218 downward (in the direction of arrow 283 in FIG. 10A) so that the pin 279 is received in the opening 281. Desirably, pin 279 and opening 281 are sized so that pin 279 fits snugly into opening 281, providing a friction fit. The force required to remove catching mechanism 218 from holding member 275 can vary according to the tightness of the fit between pin 279 and opening 281. The tighter the fit, the greater the force required to remove the catching mechanism from the holding member 275.

Depending on the application and the amount of temporary holding force desired, the shape and number of pins (and corresponding openings) can be varied. However, as discussed above, the retaining force provided by the fit of the pin 279 into the opening 281 is desirably sufficient to hold the catching mechanism 218 on the plate 279 until an obstacle impacts the catching mechanism 218 to begin dispensing tape from the next staged spool.

Holding members, such as those discussed above, can be formed in a variety of configurations, shapes, and orientations (relative to the active tape and support member), as long as they are capable of releaseably holding the catching mechanisms. In addition, it should be understood that any number of holding members 250 can be used, and that such holding members can be used to hold some or all of the catching mechanisms present in the dispensing apparatuses disclosed herein.

Figure 11:
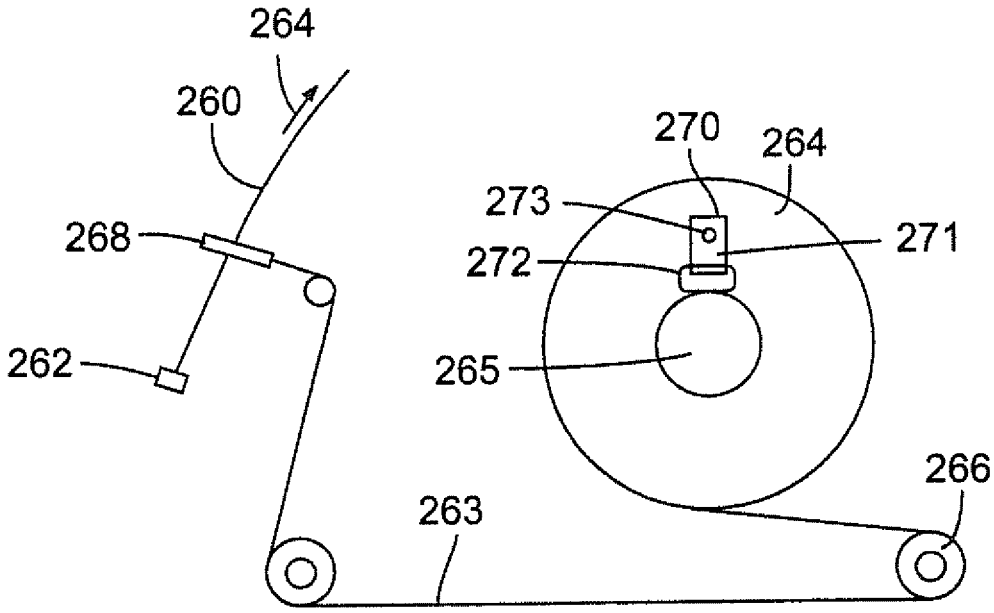
FIG. 11 is a schematic view of a resisting member in a configuration that resists the rotational movement of a spindle.

FIG. 11 shows another embodiment of a method and apparatus for reducing the likelihood that an unintentional obstacle (e.g., imperfections such as glue globs) will cause tape from a staged spool to be prematurely spliced onto tape from the active spool. As schematically shown in FIG. 11, tape 260 is being actively dispensed in a direction 261 from a spool (not shown). Tape 260 has an obstacle 262 (e.g., a pin) positioned at a trailing end portion of the tape spool. A second staged spool 264 is positioned on a spindle 265. Tape 263 from the spool 264 is drawn around a fixed roller 266 and terminates at a catching mechanism 268 associated with a leading end portion of tape 263. Tape 260 passes through (or near) the catching mechanism 268 so that when the obstacle 262 engages catching mechanism 268, the leading end portion of tape 263 is spliced to the trailing end portion of tape 260.

In order to reduce the likelihood that an unintentional obstacle will begin drawing tape 263 from the spool 264, a rotation resisting member 270 can be positioned to apply a force to the spindle 265. The resisting member 270 can comprise, for example, an arm 271 and a bumper 272 that is biased towards the spindle 265 to frictionally engage the spindle 265 and resist rotational movement of the spindle 265. The arm 271 can be pivotably mounted to a pivot member 273. The amount of force applied to the spindle 265 by the resisting member 270 can vary, but is desirably a sufficient amount to prevent the spindle 265 from rotating (and thus dispensing tape) until the obstacle 262 engages the catching mechanism 268. Thus, if unintentional obstacles impact the catching mechanism 268, the resisting member prevents the impact of the unintentional obstacle from rotating spindle 265 and dispensing tape 263 from the staged spool 264.

Figure 12:
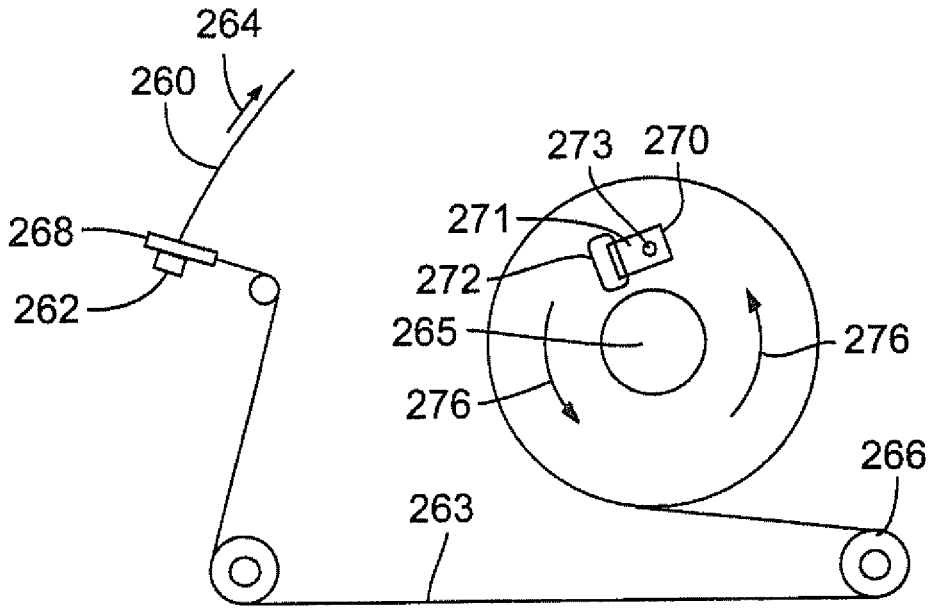
FIG. 12 is a schematic view of a resisting member in a configuration that does not substantially resist the rotational movement of a spindle.

FIG. 12 illustrates the manner in which the resisting member 270 can release the spindle 265, permitting rotation of spindle 265 and the dispensing of tape 263 from spool 264, which is positioned on spindle 265. As shown in FIG. 12, when obstacle 262 impacts the catching mechanism 268, the leading end portion of tape 263 is spliced to the trailing end portion of tape 260. The force provided by obstacle 262 engaging with the catching mechanism 268 provides sufficient torque on spindle 265 to overcome the resistive force applied on the spindle 265 by the resisting member 270. Accordingly, as shown in FIG. 12, the torque caused by tape 263 being pulled (via the obstacle impacting the catching mechanism) causes spindle 265 to rotate in the direction shown by arrows 276, which in turns pulls the bumper 272 off of the spindle 265, thereby removing (and/or reducing) the resistive force applied by the resisting member 270 on the spindle 265.

The resisting member 270 can be formed in a variety of configurations and shapes, so long as they are capable of limiting or resisting rotation of a spindle until a sufficient amount of force is applied to tape of a staged spool to overcome the holding force of the resisting member 270. For example, the resisting member could be configured to apply a force to a flat surface on an end of the spindle rather than to the curved portion of the spindle as shown in FIG. 11. Moreover, it should be understood that a resisting member can be configured to apply a resistive force to locations other than the spindle to prevent rotation of the spindle. For example, a resisting member could prevent rotation of the spindle by applying a force directly to the spool on the spindle. In addition, it should be understood that any number of resisting members can be used, and that such resisting members can be used to resist the rotation of some or all of the spindles present in the dispensing apparatuses disclosed herein.

The systems and methods disclosed herein can also be used with a tension control mechanism such as that disclosed in U.S. Pat. No. 7,007,883, the entire disclosure of which is incorporated herein by reference. The '883 patent discloses a tension control method that can help to prevent the tape material from going slack when dispensing is slowed or stopped.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An apparatus for dispensing elongated material from a roll of material, comprising:

a first spool of elongated material having a trailing end portion and a first obstacle element secured to its trailing end portion;

a second spool of elongated material having a leading end portion and a first catching mechanism secured to the leading end portion, the second spool also having a trailing end portion with a second obstacle element secured to its trailing end portion;

a third spool of elongated material having a leading end portion and a second catching mechanism secured to its leading end portion; and a support member configured to at least partially support the leading end portions of both the second and third spools while the first and second catching mechanisms at least partially surround at least a portion of the elongate materials from the first and second spools, respectively, wherein the first obstacle element is sized to engage the first catching mechanism when the first obstacle element and the first catching mechanism are brought into contact with each other, and the second obstacle element is sized to engage the second catching mechanism when the second obstacle element and the second catching mechanism are brought into contact with each other to provide a continuous feed of elongate material from the first, second, and third spools.

2. The apparatus of claim 1, further comprising:

a fourth spool of elongated material having a leading end portion and a third catching mechanism secured to its leading end portion, wherein the third spool further comprises a trailing end portion with a third obstacle element secured to its trailing end portion, and the third obstacle element is sized to engage the third catching mechanism when the third obstacle element and the third catching mechanism are brought into contact with each other, and wherein the support member is configured to at least partially support the leading end portions of the fourth spool.

3. The apparatus of claim 1, wherein the support member is movable from a first position to a second position.

4. The apparatus of claim 3, wherein the support member is movable from the first position to the second position by rotating the support member about a pivot member.

5. The apparatus of claim 1, wherein the support member further comprises at least one holding member configured to releasably hold at least one of the first catching mechanism and the second catching mechanism.

6. The apparatus of claim 1, wherein the support member is positioned within an outer envelope, the outer envelope comprising a perimeter defined by the outer edges of the first, second, and third spools of elongate materials.

7. The apparatus of claim 1, wherein the support member comprises a plurality of projections that extend therefrom to support the leading end portions of the second and third spools.

8. An apparatus for dispensing elongated material from a roll of material, comprising:

a first spool of elongated material having a trailing end portion and a first obstacle element secured to its trailing end portion;

a second spool of elongated material having a leading end portion and a first catching mechanism secured to the leading end portion; and a support structure that supports the first catching mechanism while the first catching mechanism at least partially surrounds at least a portion of the elongate material from the first spool, the support structure including a holding member that releasably holds the first catching mechanism relative to the support structure, wherein the first obstacle element is sized to engage the first catching mechanism when the first obstacle element and the first catching mechanism are brought into contact with each other.

9. The apparatus of claim 8, wherein the holding member is configured to apply a holding force to the first catching mechanism, the holding force being overcome when the first obstacle element engages the first catching mechanism.

10. The apparatus of claim 9, wherein the holding member is a spring clip.

11. An apparatus of claim 8, wherein the first spool of elongated material is disposed on a first spindle and the second spool of elongated material is disposed on a second spindle, the apparatus further comprising:

a resisting member moveable between a first configuration and a second configuration, wherein in the first configuration the resisting member applies a force to the second spindle to resist the rotation of the second spool of material before the obstacle engages the catching mechanism, and in the second configuration the resisting member does not apply a force to the second spindle or applies a force that is smaller than the force applied in the first configuration, wherein the resisting member is configured to be moved to the second position when the obstacle engages the catching mechanism and causes the second spool to begin dispensing material.

12. The apparatus of claim 11, wherein the resisting member comprises a bumper that engages with an outer surface of the second spool of elongate material.

13. The apparatus of claim 12, wherein the resisting member is pivotable between the first configuration and the second configuration.

14. A method of splicing elongate material in a dispenser, the method comprising:

providing a first spool of elongate material in a first position on a dispenser, the first spool having a trailing end portion and a first obstacle element secured to its trailing end portion;

dispensing material from the first spool;

providing a second spool of elongate material in a second position, the second spool having a leading end portion and a first catching mechanism secured to the leading end portion, the second spool also having a trailing end portion with a second obstacle element secured to its trailing end portion;

providing a third spool of elongated material having a leading end portion and a second catching mechanism secured to its leading end portion;

placing the first catching mechanism of the second spool around material being dispensed from the first spool;

placing the second catching mechanism of the third spool around the leading end portion of the second spool;

positioning the first and second catching mechanisms in a splicing area, the splicing area being defined by an outer envelope, the outer envelope comprising a perimeter defined by the outer edges of the first, second, and third spools of elongate materials, wherein the act of positioning the first and second catching mechanisms in the splicing area includes supporting the leading end portions of the second and third spools on a support member in the splicing area and the first, second, and third spools can dispense material in a continuous feed.

15. The method of claim 14, wherein the act of positioning the first and second catching mechanisms in the splicing area further comprises:

temporarily attaching the first and second catching mechanisms to one or more holding members on the support member.

16. The method of claim 14, further comprising:

providing a fourth spool of elongated material having a leading end portion and a third catching mechanism secured to its leading end portion;

placing the third catching mechanism of the fourth spool around material being dispensed from the third spool;

completely dispensing the elongate material from the first, second, and third spools and removing the first, second, and third spools from the dispenser;

loading a fifth spool of elongate material where the third spool of material was previously located, a sixth spool of elongate material where the second spool was previously located, and a seventh spool of elongate material where the first spool was previously located, each of the fifth, sixth, and seventh spools having leading end portions; and pivoting the support member to receive and support the leading end portions of the fifth, sixth, and seventh spools.

17. The method of claim 14, further comprising:

applying a resisting force to the second spindle to resist the rotation of the second spool of elongate material until the first catching mechanism engages the first obstacle element.

* * * * *